US006141886A

United States Patent [19]

Watson et al.

[11] Patent Number: 6,141,886

[45] Date of Patent: Nov. 7, 2000

[54] GRAIN METERING SYSTEM FOR A GRAIN DRYER HAVING IMPROVED GRAIN FLOW ANGLE CONFIGURATION AT GRAIN COLUMN DISCHARGE OPENING

[75] Inventors: L. Michael Watson, Waldron; Phillip C. Middaugh, Indianapolis, both of Ind.

[73] Assignee: ffi Corporation, Indianapolis, Ind.

[21] Appl. No.: 09/197,988

[22] Filed: Nov. 23, 1998

[51] Int. Cl.[7] ..... F26B 17/12

[52] U.S. Cl. ..... 34/166; 34/168

[58] Field of Search ..... 34/64, 166, 167, 34/168, 172, 173, 181

[56] References Cited

U.S. PATENT DOCUMENTS

| | | | |
|---|---|---|---|
| 2,552,093 | 5/1951 | Gollbach et al. | 222/312 |
| 2,740,204 | 4/1956 | Seltzer et al. . | |
| 3,000,110 | 9/1961 | Forth et al. . | |
| 3,090,133 | 5/1963 | Kline | 34/174 |
| 3,092,472 | 6/1963 | Figley . | |
| 3,097,934 | 7/1963 | Applegate . | |
| 3,129,073 | 4/1964 | Mathews . | |
| 3,233,337 | 2/1966 | Tomlinson | 34/65 |
| 3,710,449 | 1/1973 | Rathbun . | |
| 3,804,303 | 4/1974 | Fassauer . | |
| 4,067,120 | 1/1978 | Bradford . | |
| 4,152,841 | 5/1979 | Westelaken . | |
| 4,268,971 | 5/1981 | Noyes et al. . | |
| 4,308,669 | 1/1982 | Noyes et al. . | |
| 4,463,503 | 8/1984 | Applegate . | |
| 4,528,848 | 7/1985 | Häfner . | |
| 5,538,747 | 7/1996 | Mueller . | |
| 5,651,193 | 7/1997 | Rhodes et al. | 34/531 |

*Primary Examiner*—Pamela Wilson
*Assistant Examiner*—Michelle A Mattera
*Attorney, Agent, or Firm*—Maginot, Addison & Moore

[57] ABSTRACT

A grain dryer which includes a grain column through which grain may flow is disclosed. The grain column has a discharge opening. The grain dryer further includes a metering roll positioned to contact grain advancing out of the discharge opening of the grain column and a grain support member interposed between the metering roll and the discharge opening, the grain support member defining a substantially planar top surface. Rotation of the metering roll causes grain to advance out of the discharge opening, over the substantially planar top surface, and into contact with the metering roll. An angle Θ is defined between a line L1 defined by the substantially planar top surface and a horizontal line HL which intersects the line L1. The angle Θ is greater than or equal to 0°, but less than or equal to 30°.

26 Claims, 13 Drawing Sheets

GRAIN METERING SYSTEM FOR A GRAIN DRYER HAVING IMPROVED GRAIN FLOW ANGLE CONFIGURATION AT GRAIN COLUMN DISCHARGE OPENING

CROSS REFERENCE

Cross reference is made to copending U.S. patent applications Ser. No. 09/197,974, entitled "Apparatus and Method for Metering Grain in a Grain Dryer which Utilizes a Grain Flow Regulator" by Phillip C. Middaugh and L. Michael Watson, and Ser. No. 09/197,995, entitled "Grain Metering System which includes a Pivotable Grain Support Member Positioned between a Metering Roll and a Discharge Opening of a Grain Column" by L. Michael Watson and Phillip C. Middaugh, and Ser. No. 09/198,301, entitled "Grain Metering System for a Grain Dryer having Improved Grain Column Discharge Opening and Metering Roll Configuration" by L. Michael Watson and Phillip C. Middaugh, all of which are assigned to the same assignee as the present invention, and all of which are filed concurrently herewith.

BACKGROUND OF THE INVENTION

The present invention relates generally to a grain dryer, and more particularly to an apparatus and method for metering grain in a grain dryer.

In many instances, agricultural grain products must be stored for an extended period of time prior to being used. However, prior to storage, it is necessary to dry the grain to a condition in which it is less subject to molding or other deterioration. Accordingly, it has become known to remove moisture from grain by passing the grain through a grain dryer prior to storage.

Grain dryers typically have a plenum chamber through which heated air is advanced. The grain is passed through columns which surround the plenum chamber. Each column includes an inner perforated wall that is in fluid communication with the plenum chamber and an outer perforated wall which is in fluid communication with the ambient environment surrounding the grain dryer. As the grain moves through the column, heated air from the plenum chamber passes through the inner perforated wall, through the flow of grain, and out through the outer perforated wall. As the heated air moves through the flow of grain, moisture is removed from the grain.

To control the amount of moisture removed from the grain, it is necessary to precisely control the flow rate of the grain through the grain column. In particular, grain that remains in the grain column and is exposed to the heated air for an extended period of time may become too dry and even catch on fire, whereas grain that passes quickly through the grain column may retain an undesirable amount of moisture. To control the flow rate of grain through the grain column, a metering roll is utilized at a discharge opening of the grain column. In particular, the metering roll is located in a relatively narrow grain flow metering passage, and rotation of the metering roll within the metering passage causes grain to be advanced through the grain column at a desired rate. Controlling the speed of rotation of the metering roll controls the flow rate of grain through the grain dryer which, in turn, controls the amount of moisture removed from the grain.

After grain is dried in the grain column, such dried grain exits the discharge opening of the grain column and advances onto a grain support member located within the metering passage. The grain then flows over the grain support member toward the metering roll. However, some grain dryers which have been heretofore designed locate and orient its grain support member relative to the discharge opening of the grain dryer such that grain advancing out of the discharge opening of the grain column causes substantial a force to be applied to the metering roll. This causes a relatively large amount of energy to be required to rotate the metering roll. In addition, this results in a relatively large amount of ware and tear on the metering roller and its associated motor. Moreover, when a substantial force is applied to the metering roll in the above manner, the flow rate of grain through the grain column is negatively affected.

What is needed therefore is an apparatus and method for feeding grain into the metering roll of a grain dryer which overcomes one or more of the above-mentioned disadvantages.

SUMMARY OF THE INVENTION

In accordance with a first embodiment of the present invention, there is provided a grain dryer. The grain dryer includes a grain column through which grain may flow. The grain column has a discharge opening. The grain dryer further includes a metering roll positioned to contact grain advancing out of the discharge opening of the grain column and a grain support member interposed between the metering roll and the discharge opening, the grain support member defining a substantially planar top surface. Rotation of the metering roll causes grain to advance out of the discharge opening, over the substantially planar top surface, and into contact with the metering roll. An angle $\Theta$ is defined between a line L1 defined by the substantially planar top surface and a horizontal line HL which intersects the line L1. The angle $\Theta$ is greater than or equal to 0°, but less than or equal to 30°.

In accordance with a second embodiment of the present invention, there is provided an apparatus for controlling grain flow within a grain dryer. The apparatus includes a grain column though which grain may flow. The grain column has a discharge opening. The apparatus further includes a metering roll positioned to contact grain advancing out of the discharge opening of the grain column and a grain support member interposed between the metering roll and the discharge opening. The grain support member defines a substantially planar top surface, an angle $\Theta$ is defined by a line L1 defined between the substantially planar top surface and a horizontal line HL which intersects the line L1. The angle $\Theta$ is greater than or equal to 0°, but less than or equal to 30°.

It is an object of the present invention to provide a new and useful apparatus for controlling grain flow within a column of a grain dryer.

It is another object of the present invention to provide an improved apparatus and method for controlling grain flow within a column of a grain dryer.

It is still another object of the present invention to provide an apparatus for controlling grain flow within a column of a grain dryer which does not cause a substantial force to be applied to the metering roll of the grain dryer during operation thereof.

It is yet another object of the present invention to provide an apparatus for controlling grain flow within a grain column of a grain dryer which has reduced wear and tear on the metering roll of the grain dryer and its associated motor during operation of the grain dryer.

It is moreover another object of the present invention to provide an apparatus for controlling grain flow within a grain column of a grain dryer which does not orient and locate the grain support member leading to the metering roll so as to negatively affect grain flow through the grain column.

It is another object of the present invention to provide an apparatus for controlling grain flow within a grain column of a grain dryer which is relatively inexpensive to manufacture.

It is another object of the present invention to provide an apparatus for controlling grain flow within a grain column of a grain dryer which is relatively durable.

The above and other objects, features, and advantages of the present invention will become apparent from the following description and attached drawings.

DESCRIPTION OF THE PREFERRED EMBODIMENT

Figure 1:
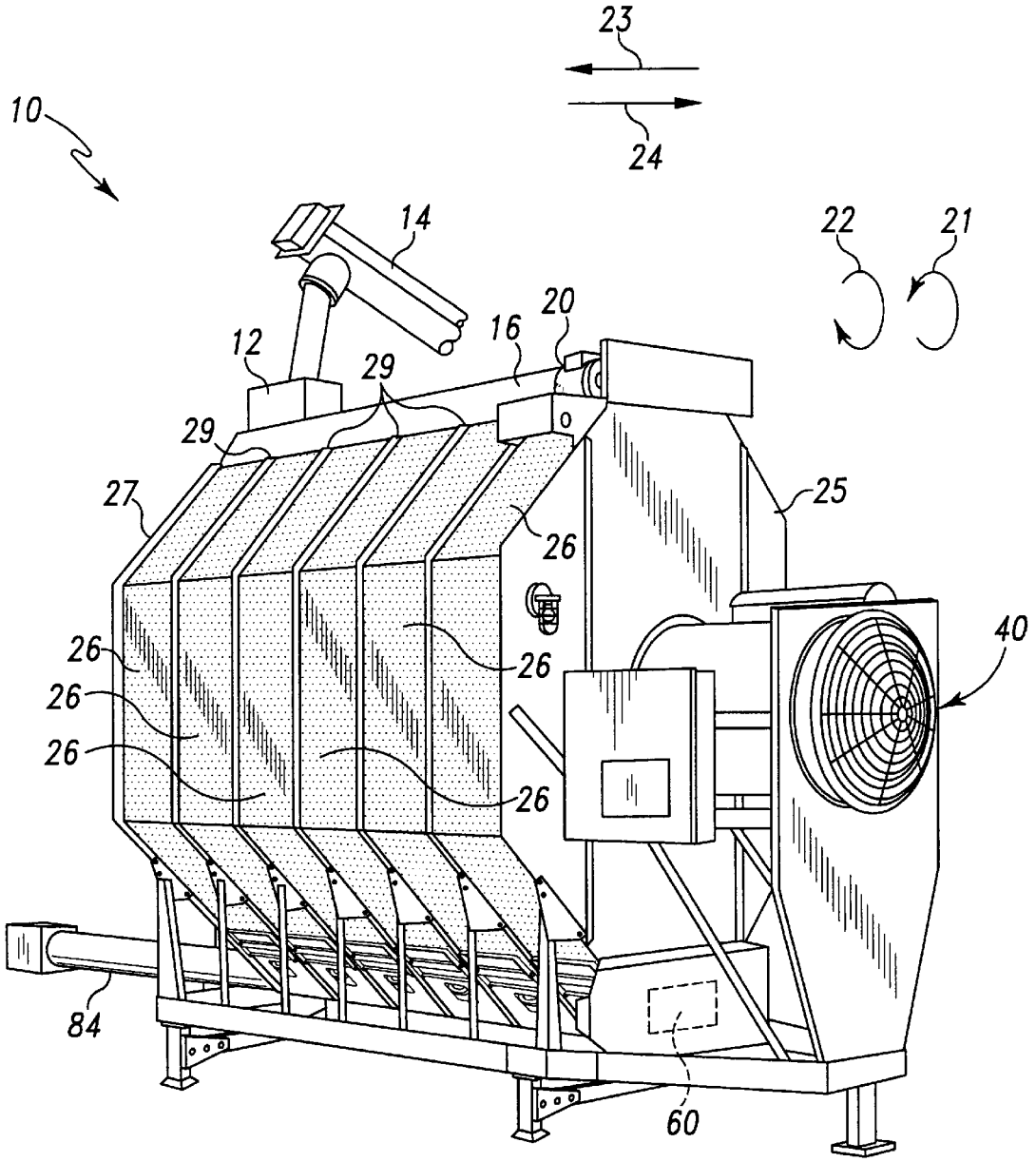
FIG. 1 is a perspective view of a grain dryer which incorporates the features of the present invention therein.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Figure 2:
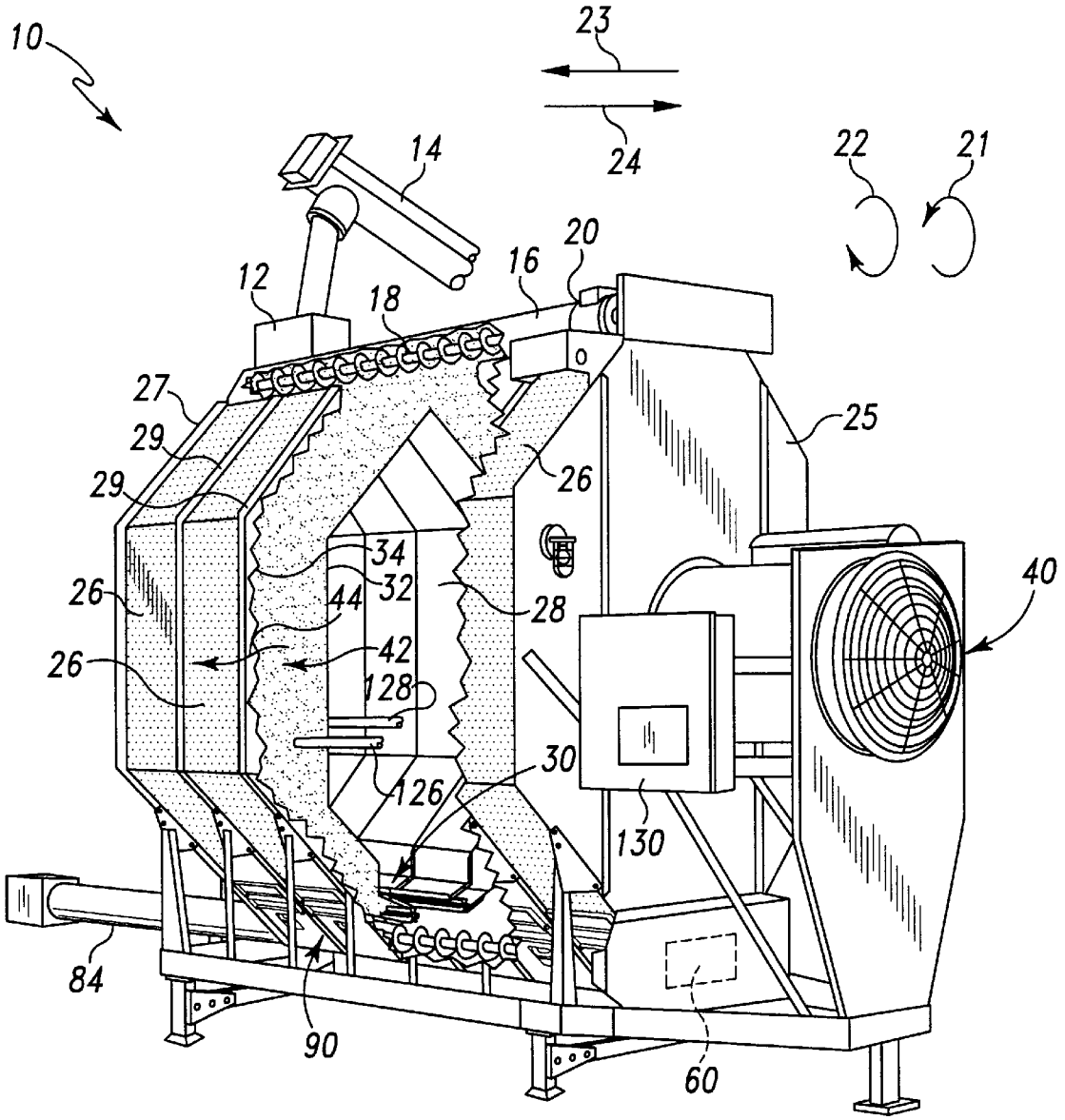
FIG. 2 is partial cut away perspective view of the grain dryer of FIG. 1, showing the plenum chamber and a number of grain columns.

Referring now to FIGS. 1 and 2, there is shown a grain dryer 10. The grain dryer 10 includes a grain inlet 12 positioned on an upper portion of the grain dryer 10. Grain from a grain source 14 is advanced through the grain inlet 12 to an inlet channel 16 defined in the upper portion of the grain dryer 10. An inlet auger 18 is positioned within the inlet channel 16 as shown in FIG. 2. An inlet motor 20 is operable to rotate the inlet auger 18 in the general direction of arrow 22. As the inlet auger 18 is rotated in the general direction of arrow 22, the rotating helical blade defined in the outer surface of the inlet auger 18 causes the grain in the inlet channel to advance in the general direction of arrow 24.

The grain dryer 10 further includes a forward wall 25, a number of columns 26, and an aft wall 27 which cooperate to define a plenum chamber 28. An upper portion of each of the columns 26 is in fluid communication with the inlet channel 29. As the grain is advanced in the inlet channel 16, grain flows from the inlet channel 16 to fill each of the columns 26 (see FIG. 2). The lower portion of each of the columns 26 is in fluid communication with a metering assembly 30 which controls the flow of grain out of the lower portion of each of the columns 26.

Each of the columns 26 includes an inner perforated wall 32 and an outer perforated wall 34. The inner perforated wall 32 allows fluid communication between the interior chamber 28 and the grain that is contained within the column 26. In particular, the perforations in the inner perforated wall 32 are large enough to allow air flow through the inner perforated wall 32, but small enough to prevent grain from passing from the column 26 to the plenum chamber 28 of the grain dryer 10. The outer perforated wall 34 allows fluid communication between the grain contained in the columns 26 and the ambient environment surrounding the grain dryer 10. In a similar manner, the perforations in the outer perforated wall 34 are large enough to allow air flow through the outer perforated wall 34, but small enough to prevent from grain from passing from the column 26 to the exterior of the grain dryer 10. In addition, each of the grain columns 26 is separated from adjacent grain columns 26 by a divider 29 (see FIG. 3).

The grain dryer 10 further includes a heating unit 40 which is operable to draw ambient air from the environment, heat the ambient air, and advance the heated air into the plenum chamber 28. It should be appreciated that the heated air in the plenum chamber 28 passes though the inner perforated wall 32 in the general direction of arrow 42 (shown in FIG. 2). The heated air then passes through the flow of grain in each of the columns 26 so as to heat and remove moisture from the grain. The heated air then exits the grain dryer 10 through the outer perforated wall 34 in the general direction of arrow 44 (shown in FIG. 2). It should be appreciated that the amount of moisture removed from the grain is a function of (i) the amount and temperature of the heated air supplied to the plenum chamber 28 by the heating unit 40, and (ii) the amount of time that the grain is exposed to the flow of the heated air that passes from the plenum chamber 28, through the inner perforated wall 32, through the flow of grain, and out to the ambient environment through the outer perforated wall 34.

Figure 3:
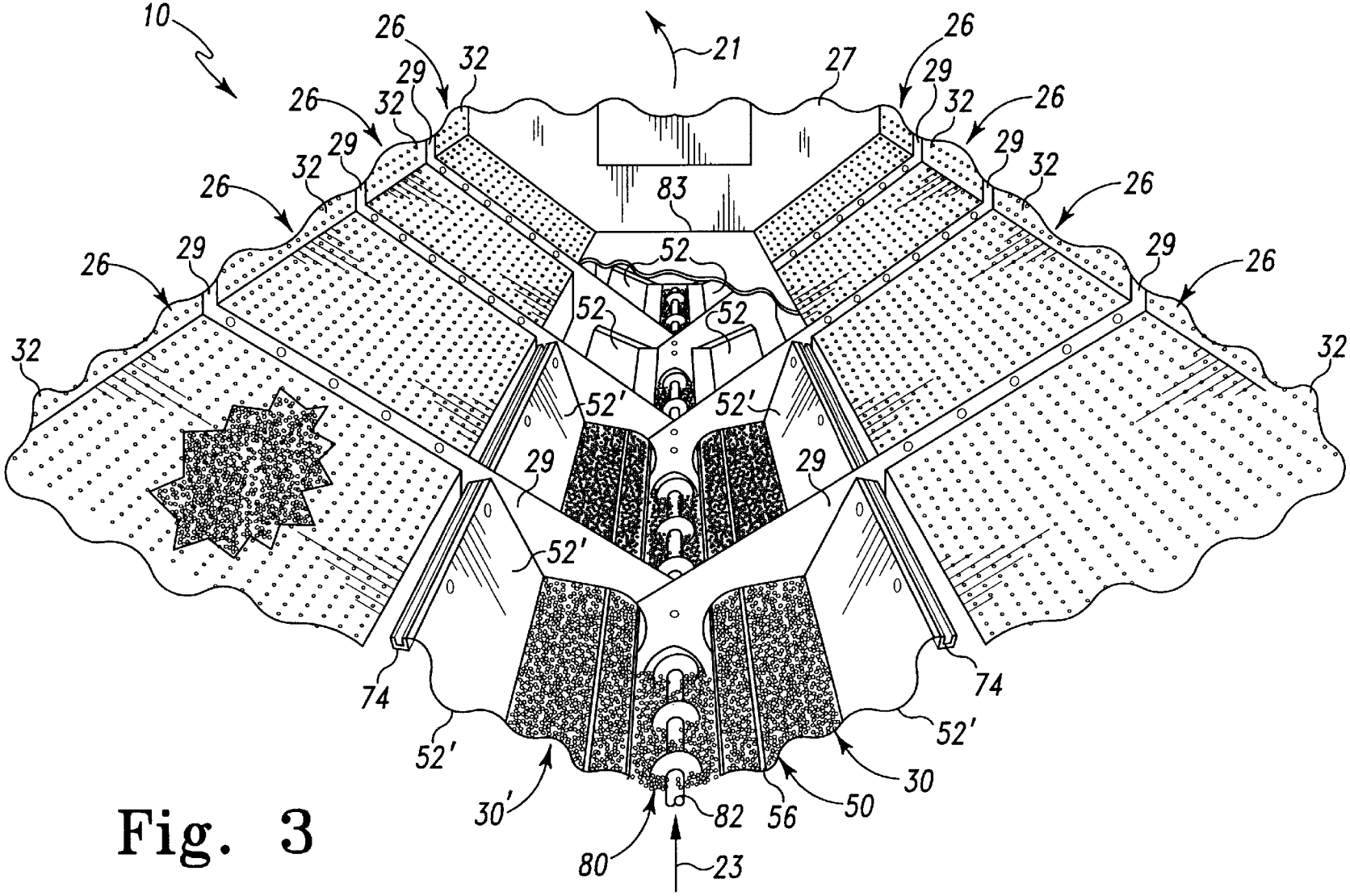
FIG. 3 is fragmentary perspective view of the inside of the grain dryer of FIG. 1, showing a number of inner perforated walls, a number of regulator members, and a transport auger.

Referring to FIG. 3, there is shown the lower portion of the grain dryer 10. The grain dryer 10 further includes a transport bin 80 located in the lower portion of the grain dryer 10. A transport auger 82 is positioned within the transport bin 80. A transport motor (not shown) is operable to rotate the transport auger 82 in the general direction of arrow 21. As the transport auger 80 is rotated in the general direction of arrow 21, the rotating helical blade defined in the outer surface of the transport auger 82 causes grain in the transport bin 80 to advance in the general direction of arrow 23. From the transport bin 80, the grain advances to a grain outlet 84 (shown in FIGS. 1 and 2), where the grain exits the grain dryer 10. A cover 83 is positioned above the transport auger 82 to isolate the transport auger 82 from the plenum chamber 28. Note that a substantial portion of the cover 83 is shown removed in FIG. 3 for clarity of description.

Figure 4:
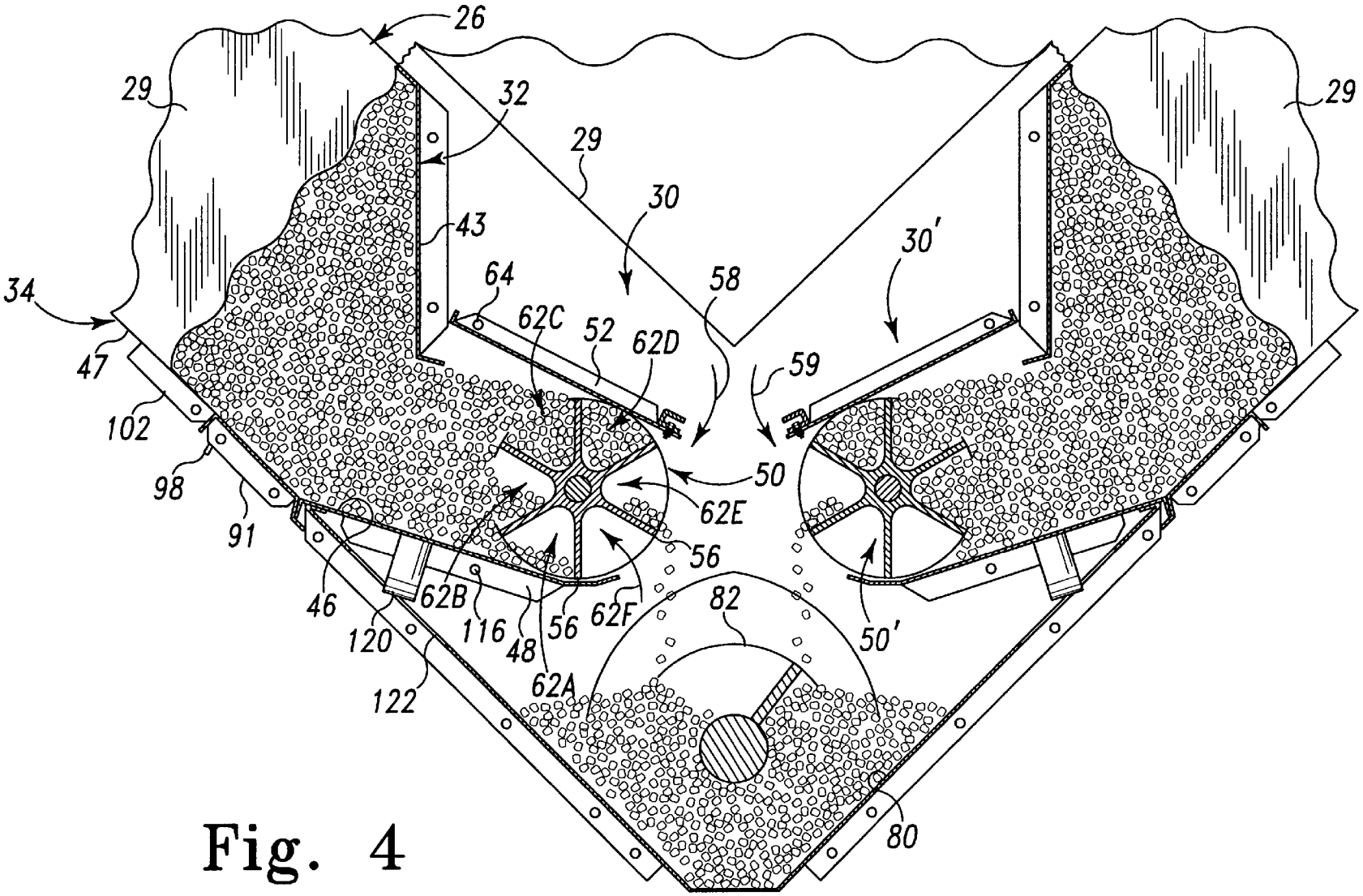
FIG. 4 is a fragmentary cross sectional view of the grain dryer of FIG. 1, showing metering rolls and regulator members.
Figure 5:
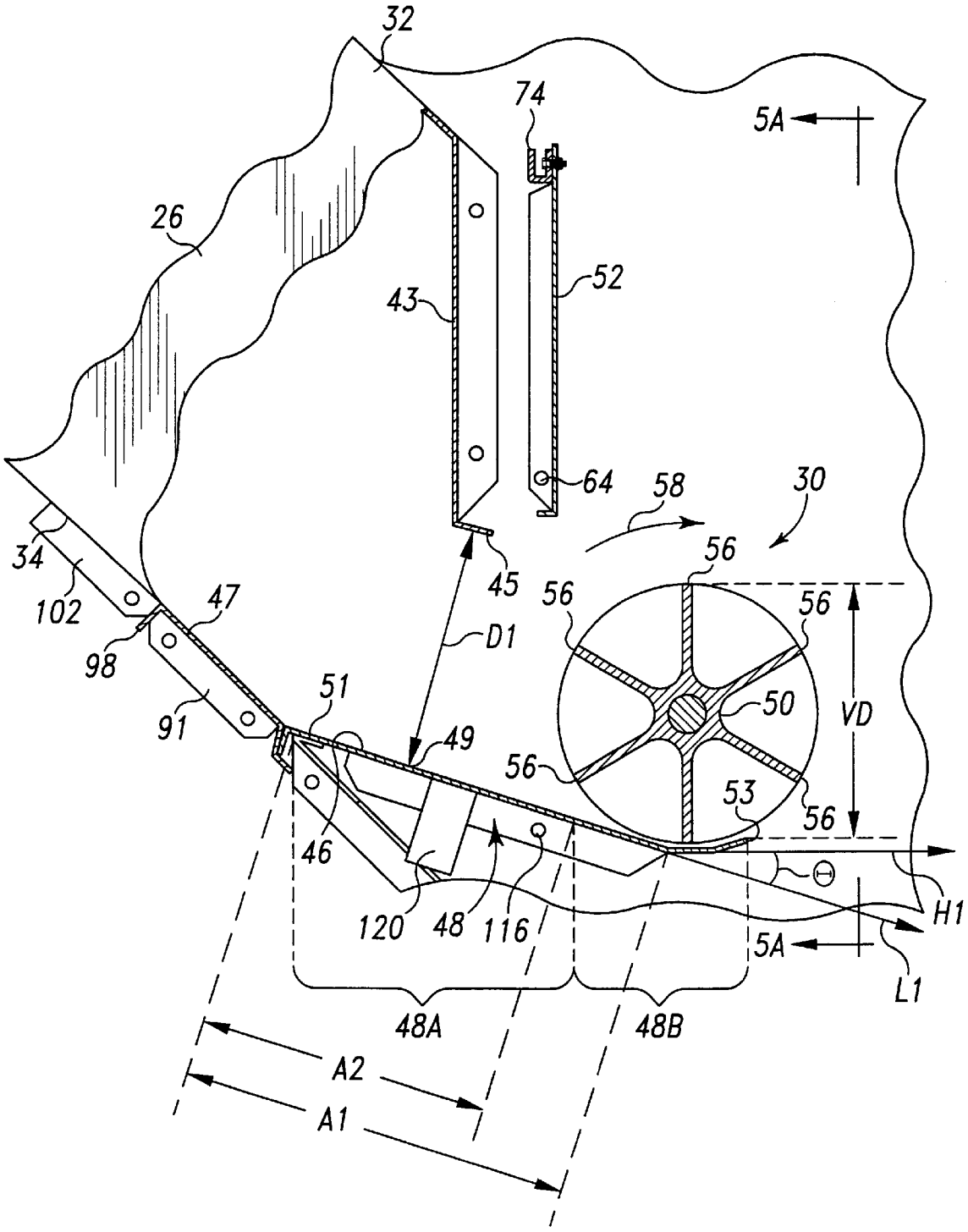
FIG. 5 is a fragmentary cross sectional view of the left side of the grain dryer of FIG. 2 showing the relative geometry of the discharge opening, metering roll, and grain support member (note that the grain is shown removed from the grain dryer for clarity of description)

Referring now to FIGS. 4 and 5 there is shown the lower portion of the interior of the grain dryer 10. The inner perforated wall 32 includes an upper column wall 43 which is positioned substantially vertically within the grain dryer 10. The lower portion of the upper column wall 43 defines an upper discharge surface 45. A grain support member 48 lies below the discharge surface 45. The outer perforated surface 34 includes a lower column wall 47. The upper portion of the grain support member 48 defines a lower discharge surface 49. The lower discharge surface 49 is the surface of the grain support member 48 which lies closest to the upper discharge surface 45. A discharge opening 46 (shown in FIG. 5) is defined by the opening that lies between the upper discharge surface 45 and the lower discharge surface 49.

It should be appreciated that the size of the discharge opening 46 is one factor that determines the amount of grain that that advances from the grain column 26. In the preferred embodiment shown, the size D1 of the discharge opening 46 is greater than or equal to 5.0 inches. More preferably, the size D1 of the discharge opening 46 is equal to about 6.6 inches. In most metering devices heretofore designed, the discharge opening is generally less than 3.0 inches. A smaller discharge opening has the advantage of allowing more precise control of the flow of grain to the metering apparatus, but has the significant disadvantage of becoming obstructed as trash objects are advanced to the metering apparatus 30.

Figure 5A:
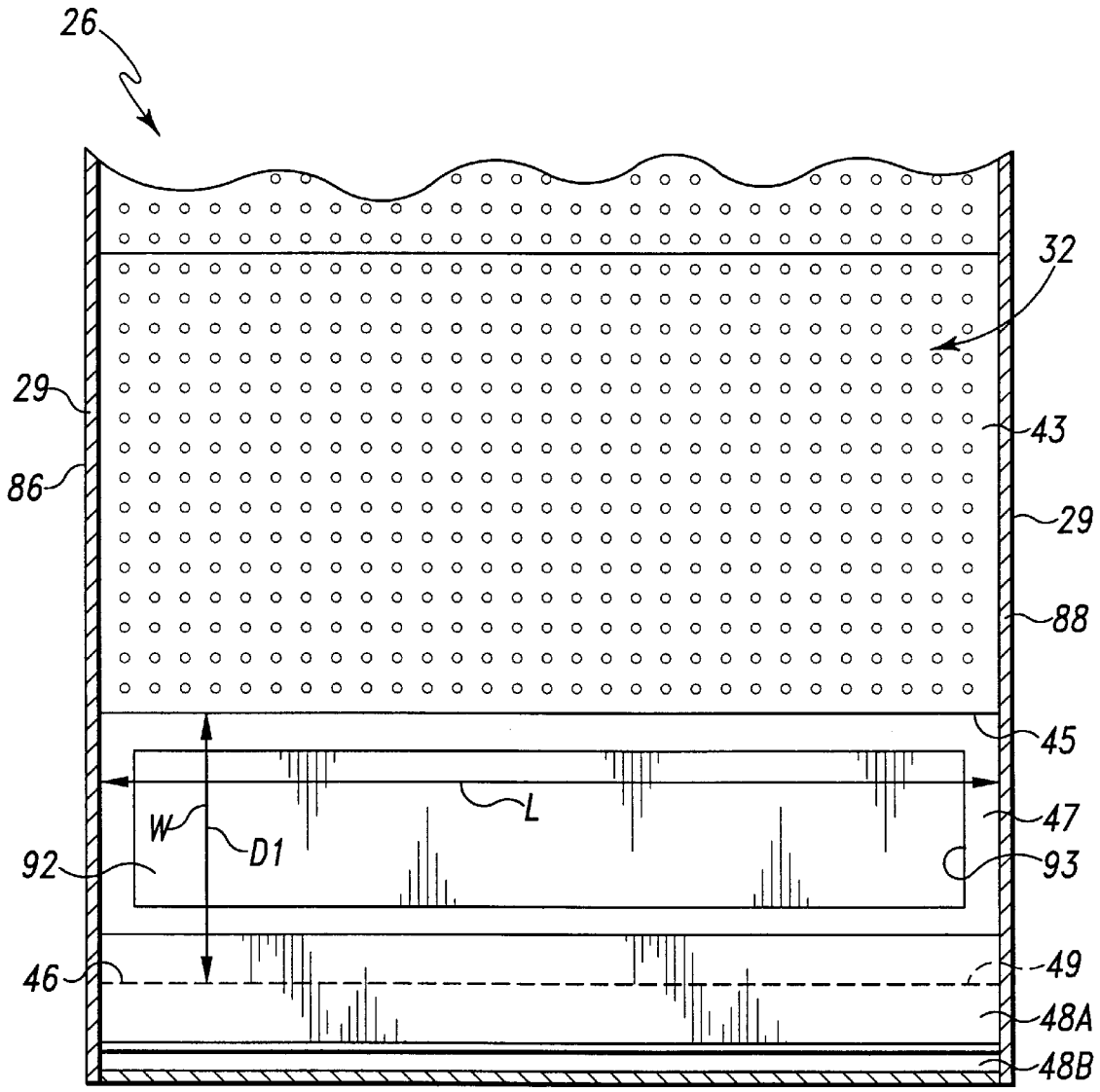
FIG. 5A is a fragmentary side elevational view of the interior of the grain dryer taken along line 5A—5A of FIG. 5, as viewed in the direction of the arrows (note that the metering roll and regulator member is shown removed for clarity of description)

Referring now to FIG. 5A, the lower discharge surface 49 and the upper discharge surface 45 define a width W which is the width of the discharge opening 46. The width W is equal to the size D1. The discharge opening 46 is further defined by a left lateral sidewall 86 and a right lateral sidewall 88. The left lateral sidewall 86 and the right lateral sidewall 88 define a length L of the discharge opening 46. The width W of the discharge opening 46 is substantially uniform along the length of discharge opening 46. In addition, the length L is substantially uniform along the width of the discharge opening. Thus, the discharge opening 46 has a substantially rectangular shape.

Referring again to FIG. 5, the metering apparatus 30 includes a metering roll 50 positioned above the grain support member 48 at a distance away from the discharge opening 46. By spacing the metering roll 50 apart from the discharge opening 46 by the distance shown in FIG. 5, the weight of the grain located in the column 26 is not directly supported by the metering roll 50. Thus, the metering roll 50 requires less energy to rotate in comparison to metering rolls which support a substantial amount of weight generated by grain in a grain column.

Referring again to FIG. 4, it should be appreciated that a second metering roll 50' is positioned on the left side of the grain dryer 10 and is substantially identical to the metering roll 50. Each of the metering rolls 50, 50', is rotatable relative to the respective grain support member 48. In particular, the metering roll 50 on the left is rotated in the general direction of arrow 58 at the same rate as the metering roll 50' is rotated in the general direction of arrow 59. Both the metering roll 50 and the metering roll 50' are driven by a metering motor 60 (shown in phantom in FIGS. 1 and 2). Since the metering roll 50' operates in a substantially identical manner to the metering roll 50, only the structure and operation of the metering roll 50 will be described in detail.

The metering roll 50 includes a number of vanes 56. Each of the vanes 56 extend longitudinally along the length of the metering roll 50 (see FIG. 3). A pair of adjacent vanes 56 forms a bucket 62 which accepts grain flowing over the grain support member 48. Since the metering roll 50 rotates in the general direction of arrow 58, the buckets move through the positions shown in FIG. 4 as 62A, 62B, 62C, 62D, 62E, and 62F. As the metering roll 56 is rotated in the general direction of arrow 58, grain from the discharge opening 46 begins to fill the bucket 62 and becomes entrapped between the vanes when the bucket 62 is positioned in the position 62A. As the bucket 62 continues to rotate in the general direction of arrow 58, additional grain from the discharge opening 46 advances into and becomes entrapped in the bucket 62 when the bucket is in the position shown as 62B. This slow filling of the bucket 62 helps to ensure the each of the buckets is completely filled as the metering roll 50 is rotated in the general direction of arrow 58. Thus, as the metering roll 50 is rotated in the general direction of arrow 58, grain is advanced from a first side of the metering roll 50 proximate to the discharge opening 46 to a second side of the metering roll 50 proximate to the transport bin 80.

Referring again to FIG. 5, the grain support member 48 includes a first end 51 which is positioned in contact with the lower column wall 47 and a second end 53 positioned under the metering roll 50. A substantially planar top surface is defined by the grain support member 48 which extends for a distance A1 in the direction of grain flow within the grain dryer 10. Note that as shown in FIG. 5, A1>VD. A grain presentation section 48A is interposed between the lower column wall 47 and the metering roll 50 whereas a grain metering section 48B is positioned under the metering roll 50. The grain presentation section 48A includes a substantially planar surface which allows grain to flow from the grain discharge opening 46 to the metering roll 50. In particular, as the metering roll 50 is rotated in the general direction of arrow 58, the grain flows from the discharge opening 46 to the metering roll 50 over the grain support member 48. Note that the lower discharge surface 49 is defined in the substantially planar surface of the presentation section 48A of the grain support member 48. Further note that the grain presentation section 48A extends for a distance A2 in the direction of grain flow within the grain dryer 10. As shown in FIG. A2>VD.

The presentation section 48A of the grain support member 48 is oriented and configured so as to enhance the flow of grain from the discharge opening 46 to the metering roll 50. In particular, the grain presentation section defines a line L1 which forms an angle θ with a horizontal line H1. The angle θ has a magnitude which is preferably between zero and thirty degrees. More preferably, the angle θ has a magnitude which is equal to about eighteen degrees. The angle θ accommodates the natural angle of repose of a grain such a corn. The angle of repose is a natural flow angle that a quantity of grain assumes as it exits a discharge opening of a grain column. Orienting the presentation section 48A to possess the angle θ relative to the horizontal line H1 facilitates uniform flow of grain from the discharge opening 46.

It should be appreciated that a significant advantage of the present invention is that the angle θ accommodates the angle of repose of a quantity of grain and allows the grain to flow uniformly from column 26. In particular, accommodating the angle of repose of the grain causes the grain near the inner perforated wall 32 and grain near the outer perforated wall 34 to advance at substantially the same rate as the grain in the center of the column 26. It should be appreciated that grain that moves through the column 26 at the same rate will have a substantially similar amount of moisture removed as it passes through the grain dryer 10. Thus, accommodating the angle of repose of the grain allows the grain in the column 26 to be dried in a substantially uniform manner.

The metering roll 50 defines a vane diameter VD. In particular, the vane diameter VD is defined as the distance between the tips of two vanes, where the two vanes 56 are spaced 180° apart from each other as shown in FIG. 5. In the preferred embodiment, the vane diameter is greater than or equal to six inches. More preferably, the vane diameter is equal to about seven inches. An advantage to such a large vane diameter VD, is that trash objects are less likely to obstruct the flow of grain through the metering roll 50.

Figure 5B:
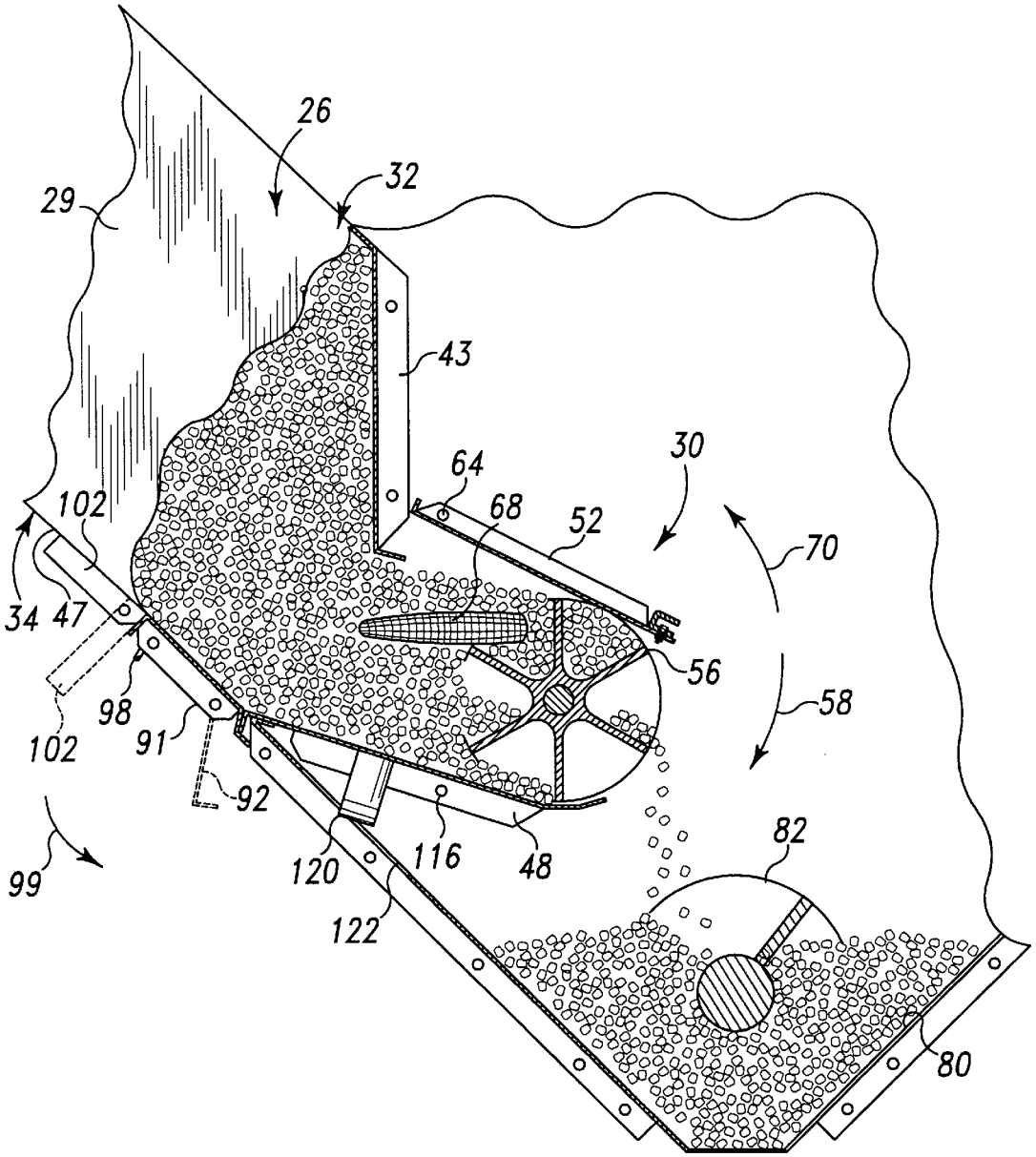
FIG. 5B is a fragmentary cross sectional view of the left side of the grain dryer of FIG. 2, but showing a trash object located in a metering passage of the grain dryer.
Figure 5C:
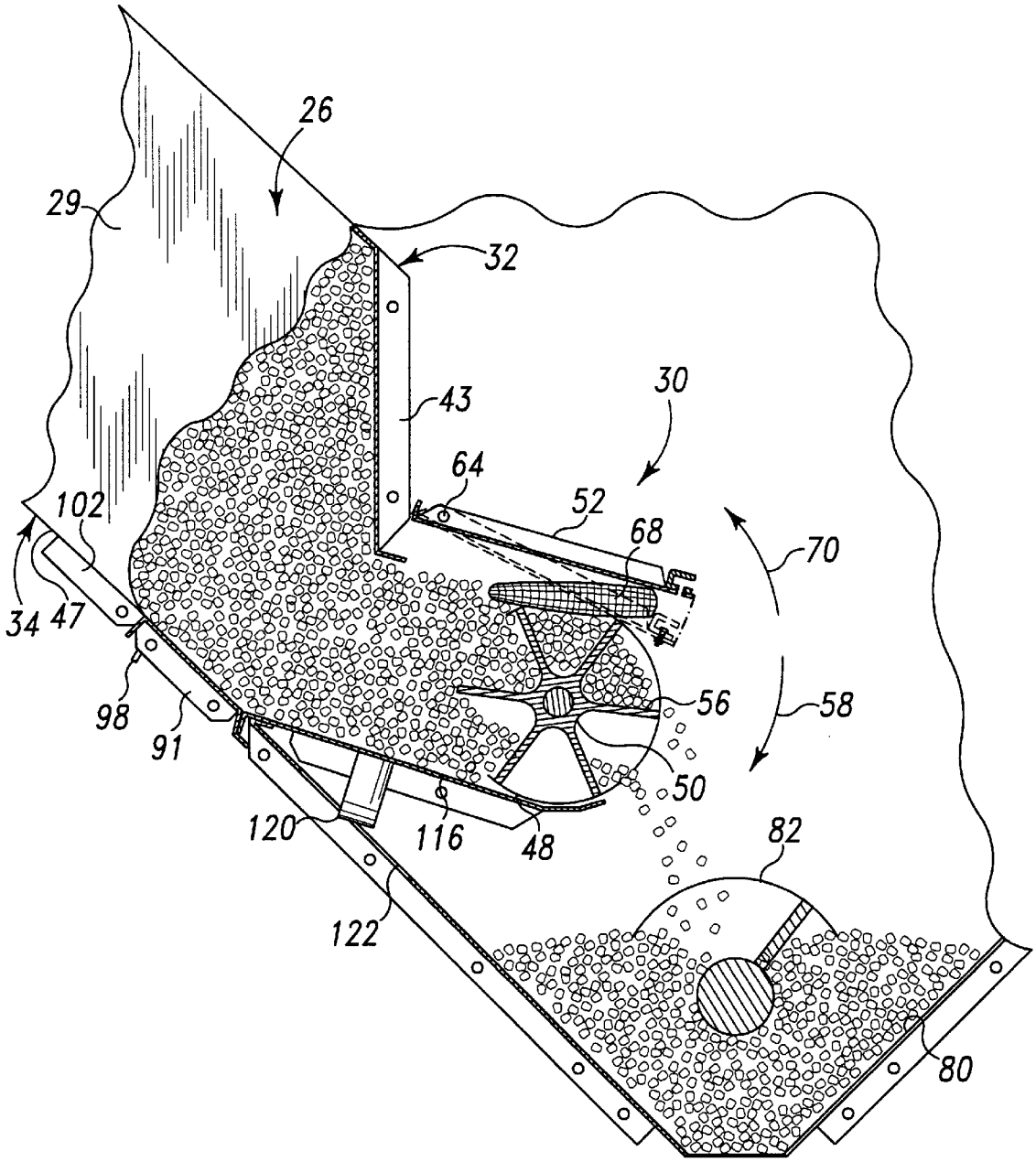
FIG. 5C is a view similar to FIG. 5B but showing the trash object advancing between the metering roll and the regulator member.
Figure 5D:
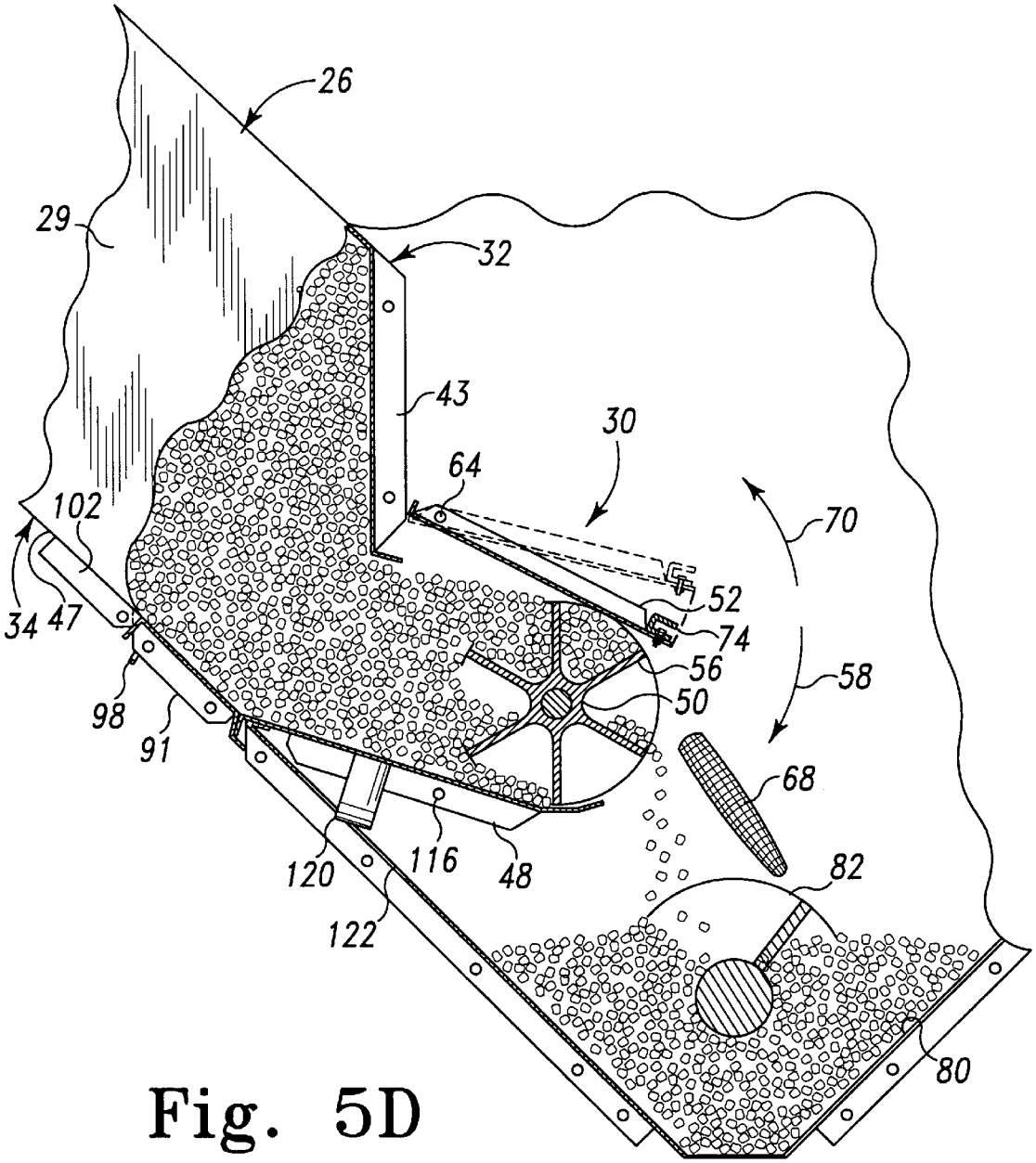
FIG. 5D is a view similar to FIG. 5C, but showing the trash object advanced to a position beyond the metering roll.

Referring now to FIG. 5B, 5C, and 5D, the metering apparatus 30 further includes a regulator member 52. The regulator member 52 controls the amount of grain advanced by each bucket 62 of the metering roll 50, regardless of the rotational speed of the metering roll 50. The regular member 52 pivots about a rod 64 secured to the dividers 29 which separate adjacent columns 26 from each other. In particular, the regulator member 52 pivots between a flow regulating position, shown in FIG. 5B, and a trash escape position shown in FIG. 5C. The regulator member 52 can also be placed in a storage position, shown by the regulator members 52' in FIG. 3. In the flow regulating position, gravity acts to pivot the regulator member 52 in the general direction of arrow 58. In the flow regulating position, the regulator member 52 is supported by either a vane 56 or the grain positioned in a bucket 62 shown in the position of bucket 62D of FIG. 4.

The regulator member 52 and the vanes 56 cooperate to control the amount of grain advanced by the rotation of the metering roll 50. The slow filling of the buckets 62 caused by rotating the metering roll from the position 62A to the position 62D ensures that each of the buckets 62 fills completely with grain as the metering roll 50 is rotated in the general direction of arrow 58. The weight of the regulator member 52 acting on the grain prevents grain that extends beyond the tip of the vanes 56 from advancing from the discharge opening 46 to the transport bin 80 as the metering roll 50 is rotated in the general direction of arrow 58.

A trash object 68 may become intermixed with the grain during either the harvesting or storage of the grain. Such trash objects 68 may include corn cobs, plant stalks, leaves or other agricultural non-grain objects. As the grain is advanced toward the metering roll 50, the trash object 68 is also advanced from the discharge opening 46 to a first position (shown in FIG. 5C). In the first position, the force of the vanes 56 acting on the trash object 68 causes the trash object 68 to be urged against the regulator member 52. If the regulator member 52 were fixed, the trash object 68 could become wedged between the vanes 56 and the regulator member 52, possibly preventing rotation of the metering roll 50, and stopping the operation of the grain dryer 10.

However, the pivotal attachment of the regulator member 52 allows the trash object 68 to pass between the vanes 56 of the metering roll 50 and the regular member 52. In particular, as the trash object 68 moves from the position shown in FIG. 5B to the first position shown in FIG. 5C, the trash object 68 causes the regulator member 52 to pivot in the general direction of arrow 70 from the flow regulating position (shown in FIG. 5B) to the trash escape position (shown in FIG. 5C) thereby allowing the trash object 68 to pass between the vanes 56 of the metering roll 50 and the regulator member 52. From the first position, the trash object 68 passes to a second position in the transport bin 80 (shown in FIG. SD) and thereafter is advanced by the transport auger 82 out of the grain outlet 84.

Figure 6:
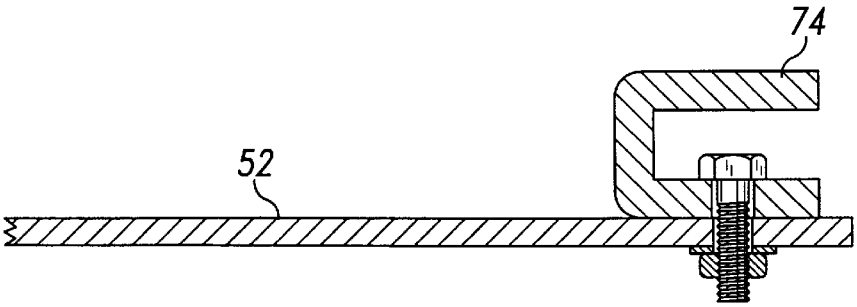
FIG. 6 is a fragmentary cross sectional view of the regulator member of FIG. 5D.
Figure 7A:
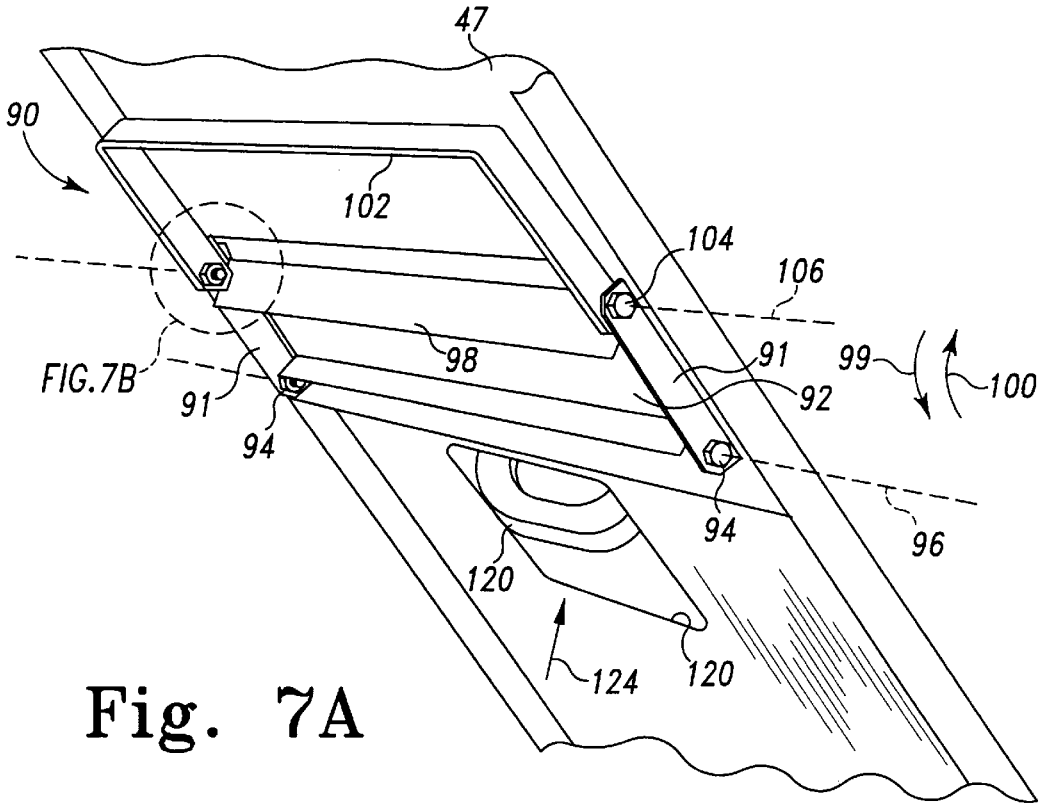
FIG. 7A is a fragmentary perspective view of the dump door of the grain dryer of FIG. 1, note that the dump door is shown in the closed position.
Figure 7B:
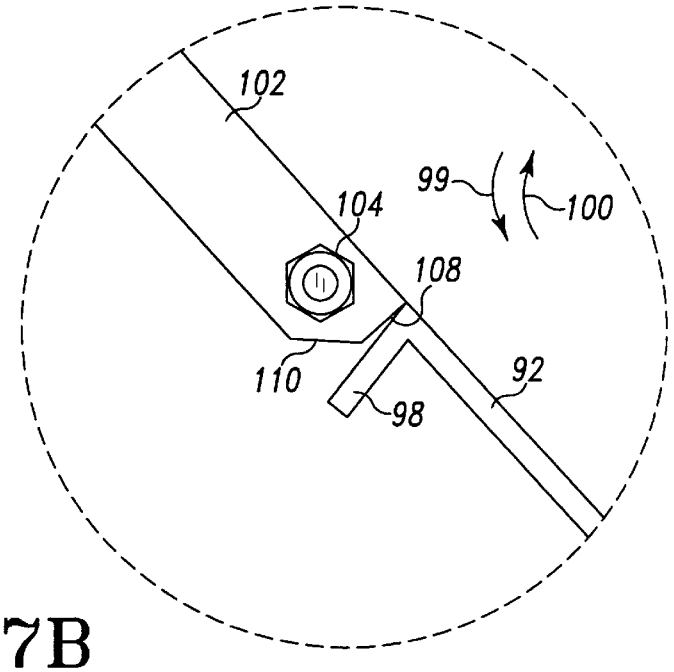
FIG. 7B is an enlarged side elevational view of the grain dryer components which are encircled in FIG. 7A and indicated as FIG. 7B.
Figure 7C:
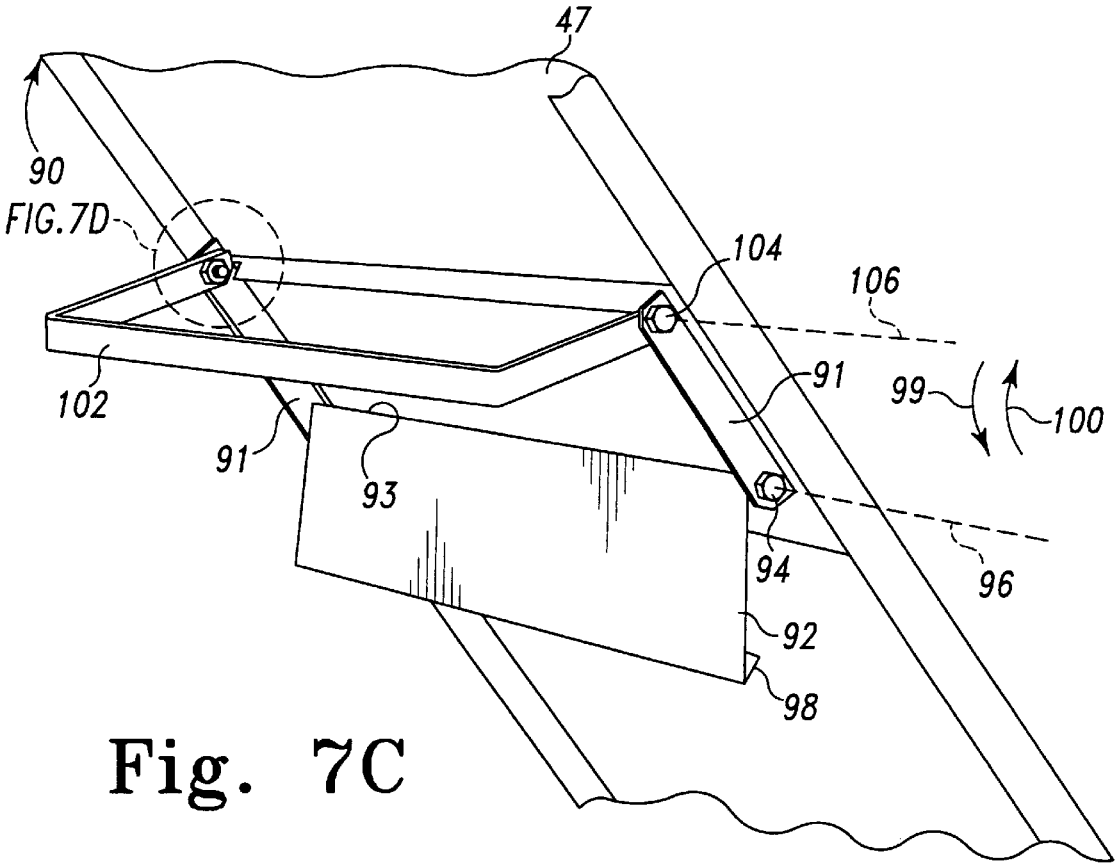
FIG. 7C is a fragmentary perspective view of the dump door of FIG. 7A, but showing the dump door in the open position.
Figure 7D:
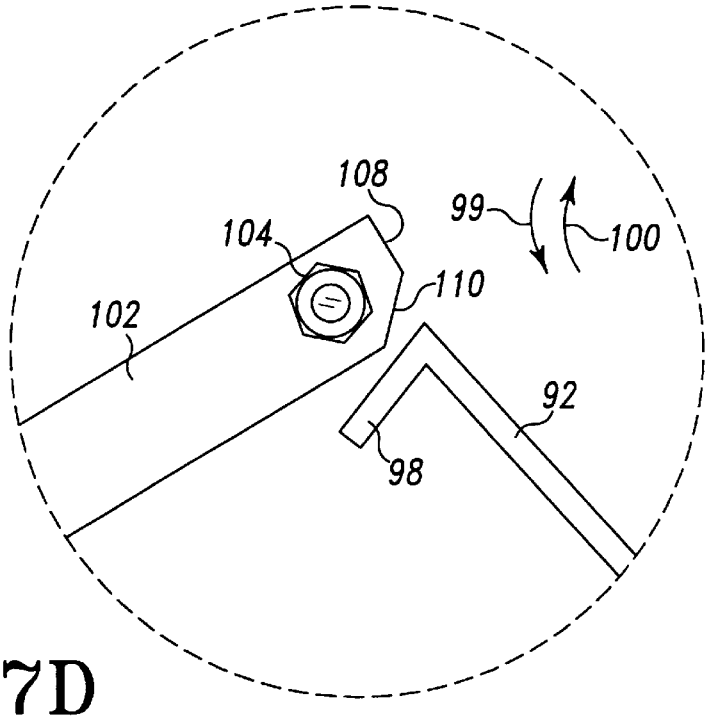
FIG. 7D is an enlarged side elevational view of the grain dryer components which are encircled in FIG. 7C and indicated as FIG. 7D.

It should be appreciated that the regulator member 52 is advantageously weighted so that the regulator member 52 remains in the regulating position when grain is present between the vanes 56 of the metering roll 50 and the regulator member 52, and moves to the trash escape position when a trash object 68 is placed between the vanes 56 and the regulator member 52. To this end, an ancillary weight 74 (see FIG. 6) is attached to an end of the regulator member 52 by a fastener 75. The effect of the ancillary weight 74 helps cause the regulator member 52 to be maintained in the regulator position until a trash object 68 of sufficient size is able to urge the regulator member 52 from the flow regulating position to the trash escape position.

Referring now to FIGS. 7A, 7B, 7C, and 7D, there is shown an emergency release mechanism 90 positioned on the lower column wall 47. The emergency release mechanism 90 includes an emergency door 92 which is pivotally secured to a bracket 91 on the lower column wall 47 by a pair of fasteners 94. The emergency door 92 can rotate about an axis 96 in the general direction of arrows 99 and 100. The emergency door 92 covers an exit opening 93 defined in the outer perforated wall 34 (see FIGS. 5A and 7C). A beveled portion 98 is defined along an upper edge of the emergency release door 92.

An actuator 102 is also pivotally secured to the bracket 91 by a pair of fasteners 104 such that the actuator 102 can rotate about an axis 106. The ends of the actuator 102 proximate to the fasteners 104 each include a retaining portion 108 and a notched portion 110. When the actuator is in a first position (shown in FIGS. 7A and 7B), the retaining portion 108 of the actuator 102 holds the beveled portion 98 of the emergency door 92 against the lower column wall 47. Holding the beveled portion 98 against the lower column wall 47 places the emergency door 92 in a closed position which prevents grain from exiting the grain column 26 via the exit opening 93 (see FIG. 5B).

When the actuator 102 is rotated in the general direction of arrow 99, the retaining portion 108 of the actuator 102 is rotated out of contact with the beveled section 98 of the emergency door 92. The notched portion 110 of the actuator 102 is moved proximate to the beveled portion 98 of the emergency door 92. The notched portion 110 allows the beveled portion 108 of the emergency door 102 to move away from the lower column wall 47 thereby allowing the emergency door 92 to rotate about the axis 96 in the general direction of arrow 99 into the open position (shown in FIG.

7C). When the emergency door 92 is placed in the open position, grain from the grain column 26 is allowed to exit the grain dryer 10 through the exit opening 93 (shown in phantom in FIG. 5B).

It should be appreciated that the emergency door 92 can be used to rapidly empty grain from the grain columns 26 in case of an emergency in the grain dryer 10. Typically, such emergencies arise when the grain or other material, such as a trash object, catches on fire within the grain dryer.

Figure 8A:
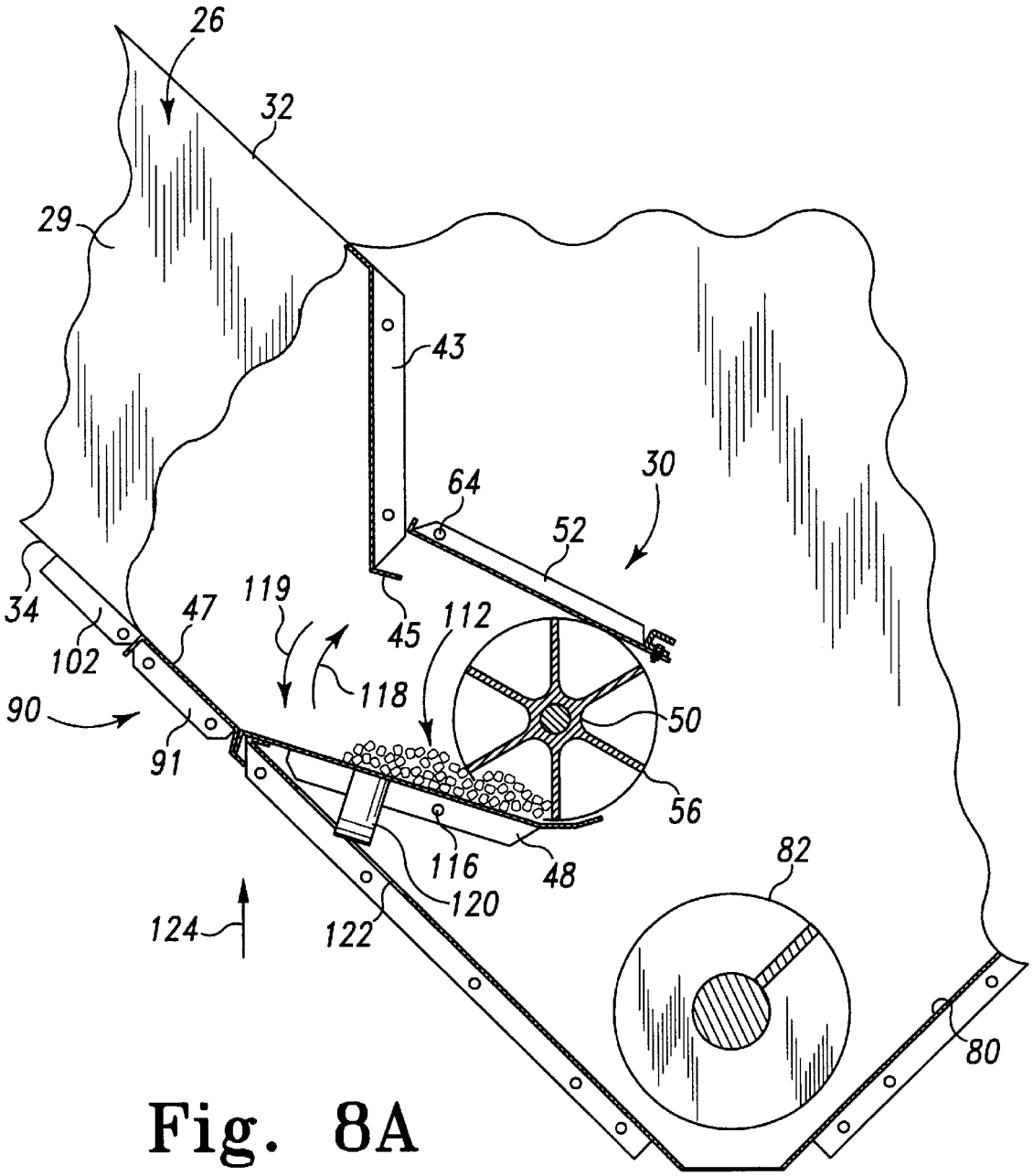
FIG. 8A is a view similar to FIG. 5, but showing a residual amount of grain on the grain support member after a grain drying operation (note that the grain support member is shown positioned in a grain support position)
Figure 8B:
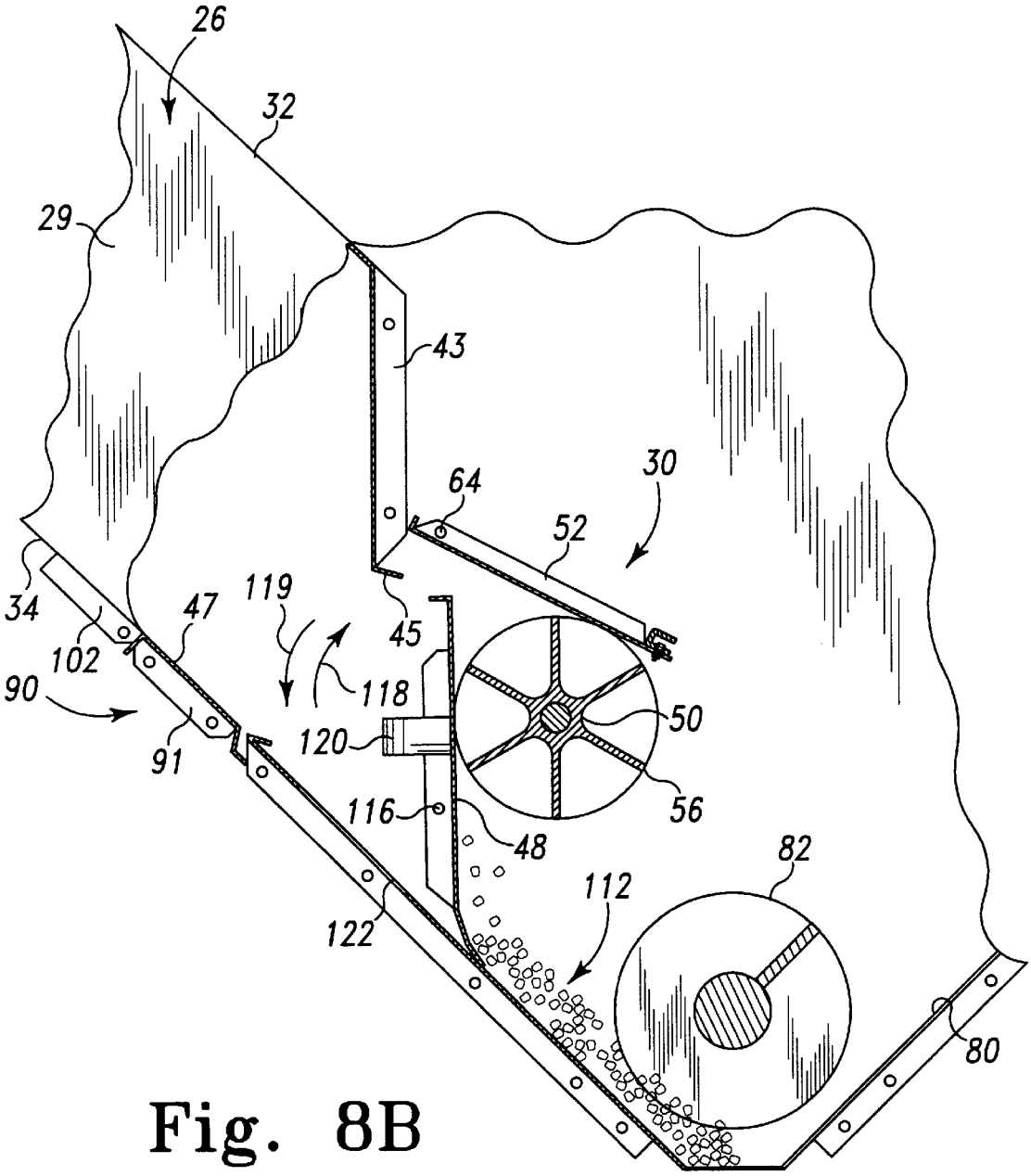
FIG. 8B is a view similar to FIG. 8A, but showing the grain support member positioned in a cleaning position.

Referring now to FIGS. 8A and 8B, there is shown the interior of the grain dryer 10 after a grain drying operation. It should be noted that an amount of residual grain 112 remains on the grain support member 48. Because of the shallow angle of the grain support member 48 from the horizontal, the residual grain 112 cannot be advanced by the metering roll 50. If the residual grain were to remain on the grain support member 48 for an extended period of time (e.g. over a winter season), the residual grain 112 could either rot or sprout, both of which are undesirable.

To remove the residual grain 112 from the grain support member 48, the grain support member 48 is pivotally secured to the dividers 29 by a rod 116. In particular, the grain support member 48 pivots from a grain support position (shown in FIG. 8A) to a cleaning position (shown in FIG. 8B) in the general direction of arrow 118. When the grain support member 48 is in the grain support position, grain must pass over the metering roll 50 prior to entering the transport bin 80. When the grain support member 48 is in the cleaning position, grain bypasses under the metering roll 50 and flows directly to the transport bin 80 from the grain support member 48.

When the grain dryer 10 is full of grain (as shown in FIGS. 5B, 5C, and 5D), the weight of the grain from the grain column 26 applies a downward force on the grain support member 48 in the general direction of arrow 119 thereby preventing the grain support member 48 from rotating about the rod 116 in the general direction of arrow 118. Thus, the weight of the grain in the grain column 26 biases the grain support member 48 into the grain support position.

To move the grain support member 48 from the grain support position to the cleaning position, a handle 120 is secured to the grain support member 48. To access the handle 120, an access opening 122 is defined in the outer surface of the grain dryer 10 (see FIG. 7A) which allows the operator to reach the handle 120 from the exterior of the grain dryer 10. To move the grain support member 48 from the grain support position to the cleaning position, an operator reaches through the access opening 122 and urges the handle 120 in the general direction of arrow 124.

Referring again to FIG. 2, the grain dryer 10 further includes a grain column temperature sensor 126, a plenum chamber temperature sensor 128, and a control unit 130. The grain column temperature sensor 126 runs through a number of grain columns 26 and is operable to sense the temperature of the grain in the columns 26 and generate a grain column temperature signal in response thereto. The plenum chamber temperature sensor 128 is positioned within the plenum chamber 28 and is operable to sense temperature of the air in the plenum chamber 28 and generate a plenum chamber temperature signal in response thereto. The control unit 130 is operable to receive the grain column temperature signal and the plenum chamber temperature signal and make adjustments to the grain drying operation.

If the grain column temperature signal indicates that the temperature of the grain in the columns 26 is too high, then the control unit 130 can either (i) increase the rate at which the metering roll 50 rotates by increasing the speed of the metering motor 60 thereby decreasing the amount of time that the grain is exposed to the heated air from the plenum chamber 28, or (ii) decrease the amount of heated air that the heating unit 40 introduces into the plenum chamber 28. On the other hand, if the grain column temperature signal indicates that the temperature of the grain in the columns 26 is too low, then the control unit 130 can either (i) decrease the rate at which the metering roll 50 rotates by decreasing the speed of the metering motor 60 thereby increasing the amount of time that the grain is exposed to the heated air from the plenum chamber 28, or (ii) increase the amount of heated air that the heating unit 40 introduces into the plenum chamber 28.

Operational Summary

During a grain drying operation, grain with a high moisture content is advanced to the inlet 12 of the grain dryer 10 (see e.g. FIG. 2). The grain advances from the inlet 12 to the inlet channel 16. From the inlet channel 16, grain is distributed among a number columns 26.

A heating unit 40 advances heated air into a plenum chamber 28. From the plenum chamber 28, the heated air passes through the inner perforated wall 32 in the general direction of arrow 42 of FIG. 2, through the flow of grain in the column 26 and out of the grain dryer through the outer perforated wall 34 in the general direction of arrow 44 of FIG. 2. As the heated air passes through the flow of grain, moisture is removed from the grain thereby drying the grain. It should be appreciated that the amount of moisture removed from the grain is a function of how long the grain remains within the column 26.

A metering assembly 30 controls the amount of grain that exits through discharge openings 46 defined in the bottom of the grain columns 26. The control unit 130 receives plenum chamber temperature signal from the plenum chamber temperature sensor 128 and grain moisture content signals from the moisture sensor 126 and generates a metering roll control signal which controls the rotational speed of the metering roll 50, and thus the flow rate of grain through the columns 26.

The relatively large width D1 of the discharge opening 46 allows a smooth flow of grain from the column 26 to the metering roll 50. In addition, the magnitude of the width D1 is large enough to allow trash objects, such as corn cobs and stalks, to pass from the column 26 to the metering roll 50. Furthermore, the relatively large vane diameter VD of the metering roll 50 helps assure that trash objects will not become lodged in the metering roll 50 as the grain is advanced to the transport bin 80.

As the grain flows from the discharge opening 46 to the metering roll 50, the grain passes through a metering passage and over the presentation section 48A of the grain support member 48. The presentation section 48A forms an angle θ with a horizontal line. The magnitude of the angle θ accommodates the angle of repose of a quantity of grain (e.g. corn) exiting the discharge opening 46 of the grain column 26, and allows the grain to flow uniformly from column 26. This uniform flow of grain facilitates uniform drying of grain within grain dryer 10.

In addition to the sizing of the metering roll 50 and the discharge opening 46, the regulator member 52 also helps to prevent trash objects from becoming jammed in the metering passage, near the metering roll 50. As the trash object 68 comes into contact with the metering roll 50, the trash object 68 is advanced in the general direction of arrow 58 by the metering roll 50 (shown in FIG. 5B). As the trash object 68 advances in the general direction of arrow 58, the trash object urges the regulator member 52 to move from the flow regulating position (shown in FIG. 5B) to the trash escape position (shown in FIG. 5C). When the regulator member 52 is in the trash escape position, the trash object 68 advances around the vanes 56 of the metering roll 50 to the transport bin 80 (see FIG. 5D). From the transport bin 80, grain as well the trash object 68 is advanced to the grain outlet 84 via the transport auger 82.

Because of the large amount of heat produced by the heating unit 40, grain or trash objects in the grain column 26 may begin to burn during a grain drying operation. When a fire is detected in the grain dryer 10, the grain in the column 26 must be rapidly emptied to prevent damage to the grain dryer 10. To empty the grain from the column 26, the actuator 102 is rotated in the general direction of arrow 99 about the axis 106 (see FIG. 7A). Rotation of the actuator 102 in the general direction of arrow 99 moves the retaining portion 108 of the actuator 102 of contact with the beveled section 98 of the emergency door 92 thereby allowing the emergency door 92 to rotate about the axis 96 in the general direction of arrow 99. As a result, grain exits the column 26 via the exit opening 93.

After the grain drying operation, grain must be emptied out of the grain dryer 10. Any grain remaining in the grain dryer 10 over an extended period of time may rot or sprout which is undesirable. Because the grain presentation section 48A has an angle of between zero and thirty degrees from the horizontal a small amount of residual grain 112 will remain on the grain support member 48 after a grain drying operation. To remove the residual grain 112 from the support member, an operator pushes the handle 120 in the general direction of arrow 124 (see FIG. 7A) which moves the grain support member 48 from the grain support position (shown in FIG. 8A) to the cleaning position (shown in FIG. 8B). In the cleaning position, the residual grain 112 flows under the metering roll 50 from the grain support member 48 to the transport bin 80. From the transport bin 80, the residual grain 112 is advanced to the grain outlet 84 by the transport auger 82.

While the invention has been illustrated and described in detail in the drawings and foregoing description, such illustration and description is to be considered as exemplary and not restrictive in character, it being understood that only the preferred embodiment has been shown and described and that all changes and modifications that come within the spirit of the invention are desired to be protected.

For example, while the emergency release mechanism 90 has been described in detail above and its design possesses many advantages, other designs of emergency release mechanisms may be used in the grain dryer 10. For instance, another design of an emergency release mechanism which may be substituted for emergency release mechanism 90 includes a slide member which is positionable to cover exit opening 93 during normal operation of the grain dryer 10. Thereafter, when it is desirable to rapidly empty grain from the grain columns 26, the slide member can be slid upwardly away from the exit opening 93 so as to allow the escape of grain through the exit opening 93. The slide member could include an upper flange portion which could be grasped by an operator of the grain dryer 10. The slide member could be slidingly attached to an outer wall of the grain dryer 10 by a number of retainer guide members which would allow the slide member to be slidable between a closed positioned in which the slide member is positioned over the exit opening 93 and an open position in which the slide member is positioned away from the exit opening 93 so as to allow grain to advance through the exit opening 93.

In addition, the grain support member 48 is described as having a handle 120 attached thereto as shown in FIGS. 8A and 8B which an operator would grasp by reaching through an opening defined in an outer wall of the grain dryer 10. While such an arrangement has numerous advantages, the grain support member may alternatively have a push rod coupled thereto in place of the handle 120. The push rod would be accessible to an operator by extending through a small hole defined in the outer wall of the grain dryer 10. When it is desirable for an operator to remove residual grain 112 from the grain support member 48, the operator would push an outer end of the push rod toward the outer wall of the grain dryer 10 thereby causing the grain support member 48 to pivot about the rod 116 so as to move the grain support member 48 from the grain support position (shown in FIG. 8A) to the cleaning position (shown in FIG. 8B) in the general direction of arrow 118.

Moreover, the flow regulator 52 is depicted in the figures (e.g. FIGS. 4 and 5) as having an ancillary weigh 74 attached thereto, and has many advantages thereby. However, it should be appreciated that the ancillary weight 74 may be eliminated if the flow regulator is made from a relatively thick piece of metal to provide increased weight to the flow regulator. This increased weight of the flow regulator 52 would help cause the regulator member 52 to be maintained in the regulator position until a trash object 68 of sufficient size is able to urge the regulator member 52 from the flow regulating position to the trash escape position.

In addition, while the flow regulator 52 is oriented so as to define a plane which intersects a horizontal line to create an angle of about 30°, and has many advantages thereby, the flow regulator may be oriented in other manners. For example, the flow regulator 52 may be oriented so as to define a plane which intersects a horizontal line to create an angle of about 45°.

What is claimed is:

1. A grain dryer, comprising:

a grain column through which grain may flow, said grain column having (i) a lower column wall, and (ii) a discharge opening through which said grain flows in a grain flow direction;

a metering roll positioned to contact grain advancing out of said discharge opening of said grain column, said metering roll having a vane diameter equal to VD; and a grain support member extending from said lower column wall, said grain support member defining a substantially planar top surface which extends for a distance A1 in said grain flow direction, and said distance A1 is greater than VD;

wherein rotation of said metering roll causes grain to advance (i) out of said discharge opening, (ii) over said substantially planar top surface, and (iii) into contact with said metering roll, and wherein an angle Θ is defined between a line L1 defined by said substantially planar top surface and a horizontal line HL which intersects said line L1, and wherein $0 \leqq \Theta \leqq 30°$.

2. The grain dryer of claim 1, wherein said grain support member is positioned relative to said metering roll such that grain flowing through said grain column advances over said grain support member prior to contacting said metering roll.

3. The grain dryer of claim 2, wherein:

said grain support member includes a first end portion and a second end portion, said first end portion of said grain support member is positioned in contact with said lower column wall, and said second end portion of said grain support member is positioned under said metering roll.

4. The grain dryer of claim 3, wherein:

said grain support member includes a grain presentation section and a grain metering section, said grain metering section is positioned under said metering roll, said grain presentation section is interposed between said grain metering section and said lower column wall, said grain presentation section extends a distance A2 in said grain flow direction, and said distance A2 is greater than VD.

5. The grain dryer of claim 4, said grain column includes a lower discharge surface, an upper discharge surface, a left lateral sidewall, and a right lateral sidewall which collectively define said discharge opening.

6. The grain dryer of claim 5, wherein:

said substantially planar top surface defines said lower discharge surface, and said grain column further includes an upper column wall, and said upper column wall defines said upper discharge surface.

7. The grain dryer of claim 1, wherein:

said metering roll includes a plurality of vanes, each of said plurality of vanes extends longitudinally along a length of said metering roll, and rotation of said metering roll causes grain advancing over said grain support member to become entrapped within a pair of adjacent vanes of said plurality of vanes.

8. The grain dryer of claim 5, wherein:

said discharge opening possesses a substantially rectangular shape, said lower discharge surface and said upper discharge surface define a width W of said discharge opening, said left lateral sidewall and said right lateral sidewall define a length L of said discharge opening, said width W is substantially uniform along said length L of said discharge opening, and said length L is substantially uniform along said width W of said discharge opening.

9. The grain dryer of claim 1, wherein said metering roll is spaced apart from said discharge opening.

10. An apparatus for controlling grain flow within a grain dryer, comprising:

a grain column though which grain may flow, said grain column having a discharge opening through which said grain flows in a grain flow direction;

a metering roll positioned to contact grain advancing out of said discharge opening of said grain column, said metering roll having a vane diameter equal to VD; and a grain support member positioned upstream of said metering roll in relation to said grain flow direction and defining a substantially planar top surface which extends for a distance A1 in said grain flow direction, said distance A1 being greater than VD, wherein (i) an angle $\Theta$ is defined between a line L1 defined by said substantially planar top surface and a horizontal line HL which intersects said line L1, and (ii) $0 \leqq \Theta \leqq 30°$.

11. The apparatus of claim 10, wherein:

said grain column includes a lower column wall, said grain support member extends from said lower column wall, and said grain support member is positioned relative to said metering roll such that grain flowing through said grain column advances over said grain support member prior to contacting said metering roll.

12. The apparatus of claim 11, wherein:

said grain support member includes a first end portion and a second end portion, said first end portion of said grain support member is positioned in contact with said lower column wall, and said second end portion of said grain support member is positioned under said metering roll.

13. The apparatus of claim 12, wherein:

said grain support member includes a grain presentation section and a grain metering section, said grain metering section is positioned under said metering roll, said grain presentation section is interposed between said grain metering section and said lower column wall, said grain presentation section extends a distance A2 in said grain flow direction, and said distance A2 is greater than VD.

14. The apparatus of claim 13, said grain column includes a lower discharge surface, an upper discharge surface, a left lateral sidewall, and a right lateral sidewall which collectively define said discharge opening.

15. The apparatus of claim 14, wherein:

said substantially planar top surface defines said lower discharge surface, said grain column further includes an upper column wall, and said upper column wall defines said upper discharge surface.

16. The apparatus of claim 10, wherein:

said metering roll includes a plurality of vanes, each of said plurality of vanes extends longitudinally along a length of said metering roll, and rotation of said metering roll causes grain advancing over said grain support member to become entrapped within a pair of adjacent vanes of said plurality of vane.

17. The apparatus of claim 14, wherein:

said discharge opening possesses a substantially rectangular shape, said lower discharge surface and said upper discharge surface define a width W of said discharge opening, said left lateral sidewall and said right lateral sidewall define a length L of said discharge opening, said width W is substantially uniform along said length L of said discharge opening, and said length L is substantially uniform along said width W of said discharge opening.

18. The apparatus of claim 10, wherein rotation of said metering roll causes grain to advance (i) out of said discharge opening, (ii) over said substantially planar top surface, and (iii) into contact with said metering roll.

19. The grain dryer of claim 1, wherein:

said grain support member includes a first end portion and a second end portion, said first end portion of said grain support member is positioned on a first side of said discharge opening, and said second end portion of said grain support member is positioned on a second side of said discharge opening.

20. The grain dryer of claim 1, wherein said discharge opening is defined, in part, by said substantially planar top surface of said grain support member.

21. The grain dryer of claim 1, wherein A1>6.0 inches.

22. The grain dryer of claim 4, wherein A2>6.0 inches.

23. The grain dryer of claim 10, wherein:

said grain support member includes a first end portion and a second end portion, said first end portion of said grain support member is positioned on a first side of said discharge opening, and said second end portion of said grain support member is positioned on a second side of said discharge opening.

24. The grain dryer of claim 10, wherein said discharge opening is defined, in part, by said substantially planar top surface of said grain support member.

25. The grain dryer of claim 10, wherein A1>6.0 inches.

26. The grain dryer of claim 13, wherein A2>6.0 inches.

* * * * *